United States Patent [19]

Vola

[11] Patent Number: 4,889,254

[45] Date of Patent: Dec. 26, 1989

[54] BOXES FOR PACKAGING OR STORAGE OF VARIOUS OBJECTS

[75] Inventor: Jean-Jacques Vola, Verrieres-Le-Buisson, France

[73] Assignee: Cosmetic Production, Paris, France

[21] Appl. No.: 262,716

[22] Filed: Oct. 26, 1988

[30] Foreign Application Priority Data

Oct. 27, 1987 [FR] France ..... 87 14803
May 26, 1988 [FR] France ..... 88 07001

[51] Int. Cl.[4] ..... B65D 25/20

[52] U.S. Cl. ..... 220/23.4; 132/294; 206/581

[58] Field of Search ..... 132/294–297; 206/581, 823; 220/23.4, 23.83

[56] References Cited

U.S. PATENT DOCUMENTS

| | | | |
|---|---|---|---|
| 3,194,426 | 7/1965 | Brown, Jr. | 220/23.4 |
| 3,338,452 | 8/1967 | Oakley et al. | 220/23.4 |
| 3,441,033 | 4/1969 | Flax | 132/295 |
| 3,862,683 | 1/1975 | Koelichen | 220/23.4 |
| 4,426,056 | 1/1984 | Gelardi et al. | 220/23.4 |
| 4,523,680 | 6/1985 | Saito et al. | 220/23.4 |
| 4,589,430 | 5/1986 | Sussman | 132/294 |
| 4,804,773 | 2/1989 | Tsai | 132/296 |

FOREIGN PATENT DOCUMENTS

| | | | |
|---|---|---|---|
| 0179005 | 4/1986 | European Pat. Off. | 206/823 |
| 1175144 | 7/1964 | Fed. Rep. of Germany | 220/23.4 |

*Primary Examiner*—Jimmy G. Foster
*Attorney, Agent, or Firm*—Young & Thompson

[57] ABSTRACT

A box of molded plastic material for packaging or storage of various objects has a box body of polygonal cross-section which may be square, for example, and a closure lid. The different sides of the box are provided with complementary male and female guides of dovetail shape, for example. The guides of one of the two series have a stop at one end. The arrangement is such that a variable number of boxes of this type can be assembled side by side so as to constitute a single-unit assembly. The boxes can be employed for individual packaging of various objects or products such as make-up products, for example.

2 Claims, 4 Drawing Sheets

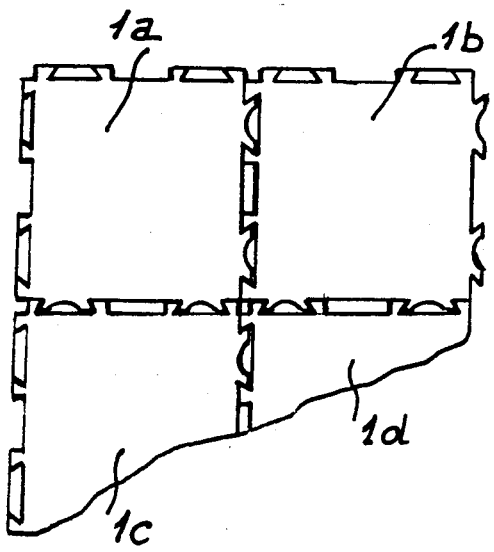
Fig: 4
Fig: 5
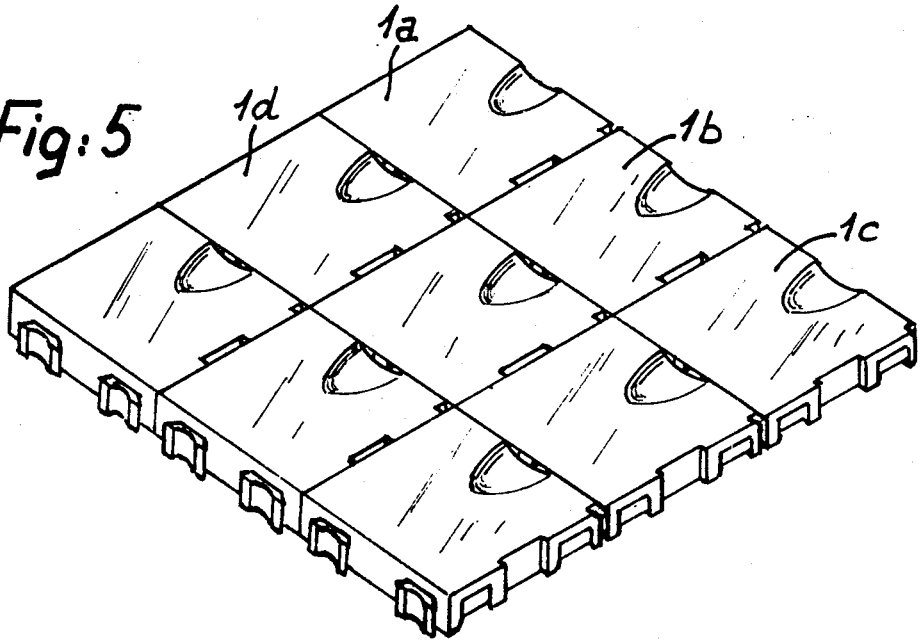

BOXES FOR PACKAGING OR STORAGE OF VARIOUS OBJECTS

BACKGROUND OF THE INVENTION

1. Field of the Invention

The present invention relates to boxes of molded plastic material for storage or packaging of various objects such as make-up products.

2. Description of the Prior Art

At the present time, products of this type and especially "eye-shadow" products are packaged in small boxes containing several make-up products of different shades. However, manufacturers as well as retailers are thus obliged to have at their disposal a stock comprising boxes containing different combinations of make-up colors. Taking into consideration the number of different possible combinations, this constitutes an objectionable drawback. Moreover, an extremely frequent problem is that users cannot find the combination of colors which interests them.

There are in fact many other instances in which products of different kinds again present the same problem.

SUMMARY OF THE INVENTION

It is for the reason given in the foregoing that the object of the present invention is to provide boxes for storage or packaging which are so designed as to be assembled together in accordance with different possible combinations. To this end, each box has a box body of polygonal cross-section with a closure lid and is essentially provided on its different sides with complementary male and female assembly guides of dovetail cross-section, for example, the guides of one of the two series being provided with a stop at one end and the arrangement being such that it is thus possible to assemble in side-by-side relation a more or less substantial number of boxes of this type so as to constitute a single-unit assembly When the boxes under consideration are employed for individual packaging of eye-shadow or like products, users can therefore readily group together a number of these boxes containing make-up products of different colors in accordance with the particular combination chosen. However, the same advantage can be profitably employed for packaging products of different kinds.

In an advantageous embodiment, the packaging boxes in accordance with the invention have a square contour and are provided with one or two male guides on two adjacent sides and with one or two complementary female guides on the two other sides, the female guides being provided at one end with a transverse flange forming a stop for the male guides.

In another improved embodiment, provision is made in addition for frames of polygonal contour each adapted to surround a variable number of packaging boxes assembled together in side-by-side relation, the internal walls of said frames being provided with guides adapted to be assembled with the guides existing on the external sides of the corresponding boxes, the frame being thus intended to form a single-unit assembly with the packaging boxes which are placed within this latter Preferably, the frame thus contemplated is provided on one face with a base having a solid or open structure or with a flange which can be placed against the face of the corresponding packaging boxes opposite to the face on which the lids of said boxes are provided.

BRIEF DESCRIPTION OF THE DRAWINGS

FIG. 4 is a fragmentary overhead plan view of a number of boxes assembled side by side.

FIG. 5 is a view in perspective representing an assembly constituted by a plurality of boxes.

DESCRIPTION OF THE PREFERRED EMBODIMENTS

Figure 1:
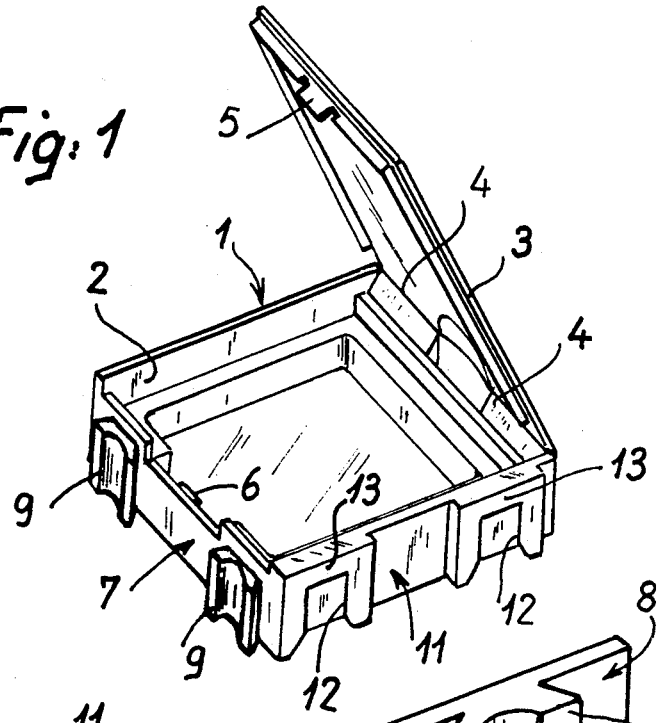
FIG. 1 is a view in perspective of a packaging box in accordance with the invention.
Figure 2:
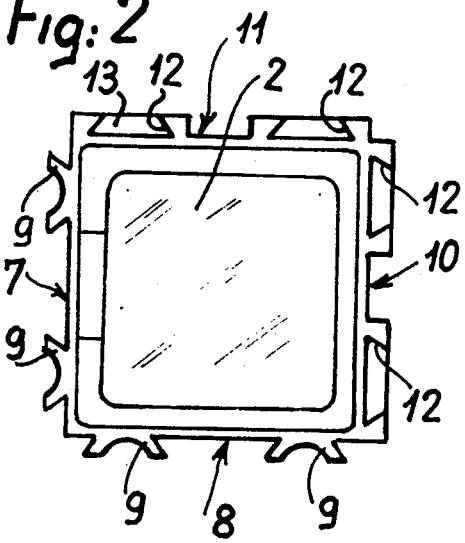
FIG. 2 is a bottom plan view of said box.

In the example illustrated in FIG. 1, each packaging box 1 in accordance with the invention has a box body 2 and a closure lid 3. However, these two parts are advantageously molded in one piece from suitable plastic material, the lid 3 being attached to the box body by means of thinned zones 4 which form a hinged connection. The free edge of the lid 3 is adapted to carry a fastening lug which is capable of resilient engagement on a retaining hook 6 carried by the box body.

In the embodiment which is illustrated, the box body 2 has a contour of square shape. The same clearly applies to the lid 3 which is hinged along one side of the box body.

The box body 2 is provided on its different sides with complementary assembly guides, namely male and female guides respectively. More precisely, two adjacent sides 7 and 8 of the box body 2 each have two male guides 9, the axis of which is perpendicular to the plane of the base of said box body. In regard to the other two sides 10 and 11, they are provided with two complementary female guides 12 which are adapted to receive the aforesaid male guides 9. These latter have a dovetail cross-section and the same applies to the female guides 12. However, one end of each female guide has a shouldered portion 13 constituting a stop which limits the depth of engagement of the male guides 9.

Figure 3:
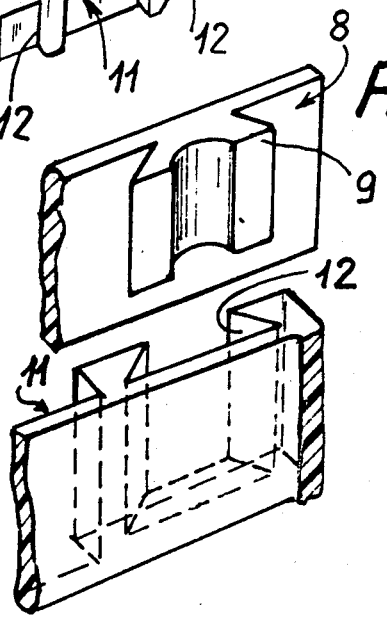
FIG. 3 is a fragmentary view in perspective illustrating the mode of coupling of the complementary guides provided on the packaging boxes in accordance with the invention.

By virtue of the arrangement thus contemplated, it is possible to assemble two identical boxes 1*a* and 1*b* in adjacent relation by engaging the male guides 9 of one of the sides 7 or 8 of the box within the female guides 12 of one of the sides 10 or 11 of the other box 1*b*. The mode of coupling of two complementary guides is illustrated in FIG. 3. At the time of assembly, the shouldered portions 13 limit the depth of engagement of the male guides in such a manner as to ensure that the top faces of the two boxes 1*a* and 1*b* are located in the same plane. However, as shown in FIGS. 4 and 5, it is possible to assemble side by side an even greater number of boxes 1*a*, 1*b*, ... . This makes it possible to construct a single-unit assembly which can group together a more or less substantial number of packaging boxes 1.

Under these conditions, if said boxes are employed for packaging eye-shadow or like cosmetic products, a user can assemble at will a number of boxes corresponding to a predetermined combination of different colors. The boxes considered can be sold individually with their contents and the required combination of colors can then be composed by the users themselves.

However, it is readily apparent that the boxes in accordance with the invention may be employed for packaging many other products. They may thus be employed for packaging pharmaceutical products presented in the form of pills or tablets or else for packaging small articles of haberdashery, notions, and so on. In all these cases, the users themselves can form assemblies which group together a more or less substantial number of boxes containing products of different kinds.

It is clearly apparent in addition that the packaging boxes in accordance with the invention are not limited to the single example of construction described in the foregoing. These boxes could thus have a polygonal contour other than a square contour and may thus have a triangular contour, for example. As to the assembly guides, they can have a shape and an arrangement which are different from those contemplated in the example described earlier. Furthermore, the boxes in accordance with the invention can be employed not only for packaging products of different kinds but also for storing objects of any type. It should be added that these boxes can be much more bulky than in the example described in the foregoing.

Figure 6:
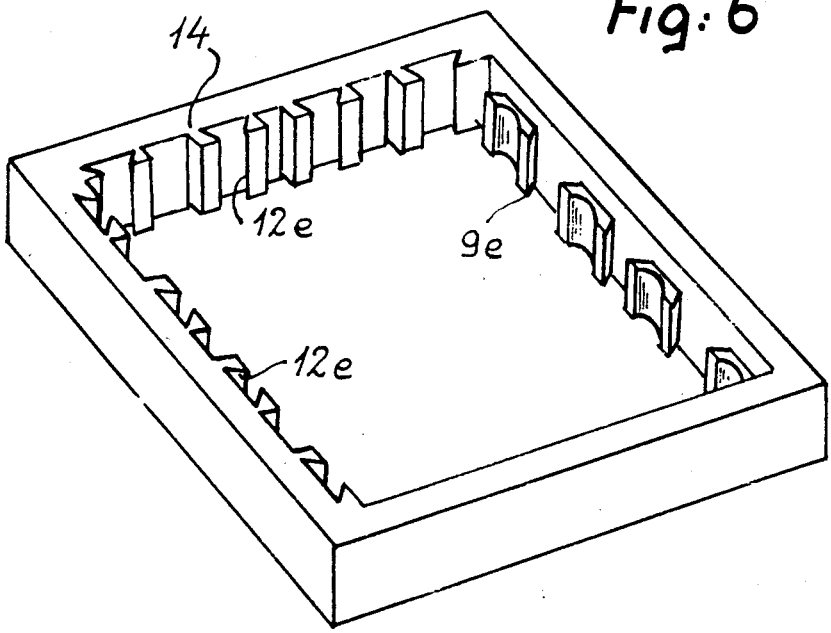
FIG. 6 is a view in perspective of a surrounding frame provided in an improved embodiment of the packaging boxes in accordance with the invention.
Figure 7:
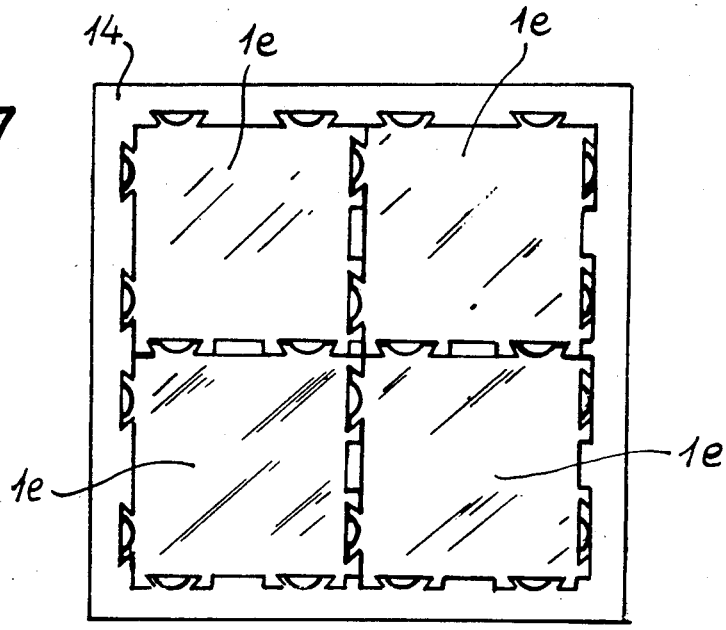
FIG. 7 is an overhead plan view of a unit constituted by the assembly of four packaging boxes and a surrounding frame fitted around said four boxes.

FIGS. 6 and 7 illustrate an improved embodiment of the packaging boxes in accordance with the invention. In this embodiment, provision is made for a frame 14 which is designed to surround four packaging boxes, these boxes being already assembled together by means of the guides existing on their different sides. In point of fact, the internal walls of said frame are in turn provided with assembly guides 9*e* and 12*e* which are identical with the guides 9 and 12 provided on the sides of said packaging boxes. Said guides are thus complementary to those of said boxes and the arrangement is such that, by placing the frame 14 around the four boxes 1*e* and by sliding this latter so as to place it in the same plane as the four boxes, it is possible to assemble the guides 9*e* and 12*e* of the internal walls of said frame with the complementary guides 12 and 9 of the free external sides of the corresponding boxes 1*e*.

In consequence, it is thus possible to constitute a single-unit assembly. As can readily be understood, the addition of the frame 14 achieves greater cohesion of the assembly which is already constituted by the four packaging boxes 1*e*.

Moreover, the added frame offers the further advantage of enhancing the general appearance of the unit. When it is in position, the frame 14 in fact conceals the assembly guides 9 and 12 which are formed on the external sides of the boxes 1*e* and which would otherwise remain visible as is the case in the example shown in FIGS. 4 and 5. Furthermore, the frame 14 itself can also constitute a decorative element by providing the frame with a distinctive color with respect to the packaging boxes 1*e*.

The surrounding frame shown in FIGS. 6 and 7 constitutes only an example. It is in fact possible to provide frames having different dimensions which can receive a greater or smaller number of packaging boxes assembled together. In an extreme case, it would be possible to provide a frame which is capable of receiving only two packaging boxes. Conversely, it would be possible to provide frames capable of receiving six packaging boxes or a much greater number.

Figure 8:
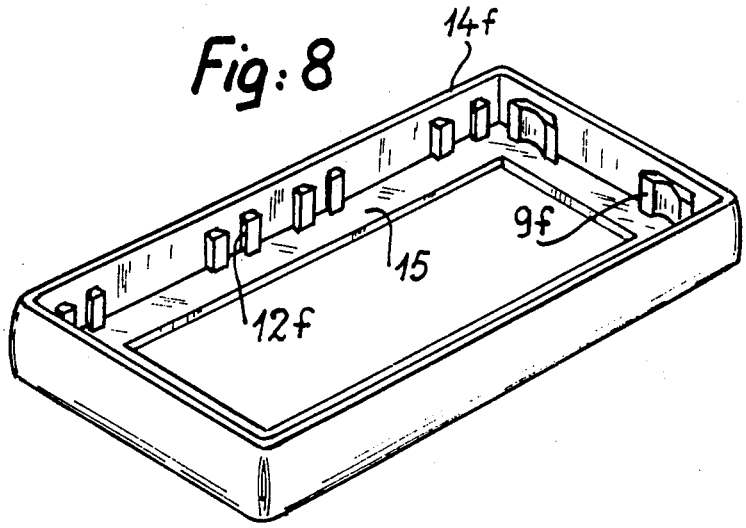
FIG. 8 is a perspective view of another example of a surrounding frame.
Figure 9:
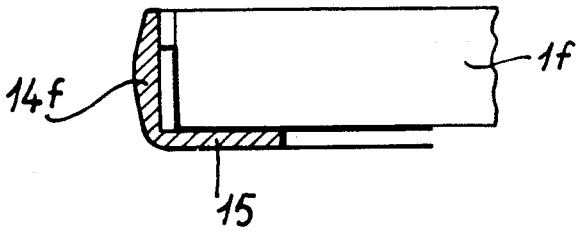
FIG. 9 is a fragmentary sectional view of said frame and of the boxes placed within this latter.

FIGS. 8 and 9 illustrate another example of a surrounding frame in accordance with the invention. The corresponding frame 14*f* is designed to receive and surround two packaging boxes 1*f* as described in the main patent. This frame differs from the preceding in the fact that its edges are provided on one face with a flange 15 of substantial width. This flange is intended to be applied against the face of each corresponding box 1*f* opposite to the face on which a lid is provided. The use of a frame 14*f* provided with a flange of this type achieves even greater cohesion of the unit thus formed.

However, instead of a simple flange 15, the frame 14*f* could have a base of solid or openwork construction which is also intended to be applied against the corresponding face of the packaging boxes surrounded by said frame.

It will readily be understood that, in either case, the engagement-limiting stops must be so arranged as to permit mounting of the packaging boxes in the desired direction. However, it would be perfectly feasible in such a case to dispense with the stops just mentioned, taking into account the presence of a flange or a base on the surrounding frame.

What is claimed is:

1. Boxes of molded plastic material for packaging or storage of various objects, said boxes having a polygonal cross-section with two opposite faces of which one is closed and the other comprises a closure lid, two series of complementary male and female assembly guides on the external sides of said boxes between said opposite faces, the guides of one of said series being provided with a stop at one end for the guides of the other series and the arrangement being such that a variable number of boxes of this type can thus be assembled in side-by-side relation, and a frame of polygonal contour surrounding a plurality of said boxes assembled together in side-by-side relation, said frame having internal walls having guides adapted to be assembled with said guides on the external sides of the boxes, the frame being thus adapted to form a single-unit assembly with the boxes which are placed within said frame.

2. Boxes according to claim 1, wherein the frame surrounding the boxes has means supporting said closed faces of said boxes.

* * * * *